US010823338B2

(12) United States Patent
Rieder et al.

(10) Patent No.: US 10,823,338 B2
(45) Date of Patent: Nov. 3, 2020

(54) GLASS LAMPS CONTAINING COBS WITH INTEGRATED ELECTRONICS

(71) Applicant: LEDVANCE GmbH, Garching bei Munich (DE)

(72) Inventors: Bernhard Rieder, Regensburg (DE); Georg Rosenbauer, Wassertrudingen (DE)

(73) Assignee: LEDVANCE GMBH, Garching bei Munich (DE)

( * ) Notice: Subject to any disclaimer, the term of this patent is extended or adjusted under 35 U.S.C. 154(b) by 0 days.

(21) Appl. No.: 15/974,760

(22) Filed: May 9, 2018

(65) Prior Publication Data

US 2018/0328544 A1 Nov. 15, 2018

(30) Foreign Application Priority Data

May 12, 2017 (DE) ..... 10 2017 110 378

(51) Int. Cl.

| | |
|---|---|
| ***F21K 9/232*** | (2016.01) |
| ***F21V 3/06*** | (2018.01) |
| ***F21K 9/238*** | (2016.01) |
| ***F21V 29/506*** | (2015.01) |
| ***F21V 19/00*** | (2006.01) |
| ***F21K 9/68*** | (2016.01) |
| ***F21V 3/02*** | (2006.01) |
| ***F21V 3/04*** | (2018.01) |
| ***F21V 23/00*** | (2015.01) |
| ***F21V 23/06*** | (2006.01) |
| *F21Y 115/10* | (2016.01) |

(52) U.S. Cl.

CPC ..... *F21K 9/232* (2016.08); *F21K 9/238* (2016.08); *F21K 9/68* (2016.08); *F21V 3/02* (2013.01); *F21V 3/049* (2013.01); *F21V 3/061* (2018.02); *F21V 3/0615* (2018.02); *F21V 19/003* (2013.01); *F21V 23/001* (2013.01); *F21V 23/005* (2013.01); *F21V 23/06* (2013.01); *F21V 29/506* (2015.01); *F21Y 2115/10* (2016.08)

(58) Field of Classification Search

CPC ..... F21K 9/232; F21K 9/238; F21V 2/506; F21V 3/0615; F21V 3/061; F21V 3/02; F21V 3/049; F21V 23/001; F21V 23/005; F21V 23/06; F21V 19/003

See application file for complete search history.

(56) References Cited

U.S. PATENT DOCUMENTS

| | | | | |
|---|---|---|---|---|
| 5,688,042 | A | 11/1997 | Madadi et al. | |
| 6,525,668 | B1 | 2/2003 | Petrick | |
| 9,420,644 | B1 * | 8/2016 | Shum | H05B 33/089 |

(Continued)

FOREIGN PATENT DOCUMENTS

| | | | |
|---|---|---|---|
| DE | 20214661 | U1 | 1/2003 |
| DE | 202010013037 | U1 | 3/2011 |

(Continued)

*Primary Examiner* — Anabel Ton

(74) *Attorney, Agent, or Firm* — Hayes Soloway PC

(57) ABSTRACT

An LED light fixture, includes a bulb, a light module with at least one light emitting diode chip which is mounted on a circuit board by means of chip-on-board assembly, and a driver of the light module, wherein the light module and the driver electronics are received in the bulb. The LED light fixture may be arranged within an enclosure to form an LED lamp.

15 Claims, 12 Drawing Sheets

(56) References Cited

U.S. PATENT DOCUMENTS

| | | | | |
|---|---|---|---|---|
| 2012/0014111 | A1 | 1/2012 | Welton | |
| 2012/0262066 | A1 | 10/2012 | Bakk | |
| 2012/0262903 | A1 | 10/2012 | Li et al. | |
| 2013/0077285 | A1 | 3/2013 | Isogai et al. | |
| 2013/0148341 | A1 | 6/2013 | Williams | |
| 2013/0271972 | A1* | 10/2013 | Hussell | F21V 3/00 362/231 |
| 2013/0271981 | A1* | 10/2013 | Hussell | F21V 7/00 362/235 |
| 2013/0294092 | A1* | 11/2013 | Hussell | F21V 29/004 362/363 |
| 2014/0103794 | A1* | 4/2014 | Ueda | F21V 23/02 313/318.01 |
| 2014/0268802 | A1 | 9/2014 | Sun et al. | |
| 2015/0085489 | A1* | 3/2015 | Anderson | F21K 9/232 362/249.06 |
| 2015/0103525 | A1 | 4/2015 | Rowley et al. | |
| 2015/0109813 | A1 | 4/2015 | Birdwell et al. | |
| 2015/0327349 | A1* | 11/2015 | Lee | F21K 9/232 362/294 |
| 2015/0345764 | A1 | 12/2015 | Hussey et al. | |
| 2016/0161062 | A1* | 6/2016 | Bergmann | F21V 23/006 362/297 |
| 2016/0348852 | A1* | 12/2016 | Kaandorp | F21V 3/02 |
| 2017/0102112 | A1* | 4/2017 | Janik | F21V 3/02 |
| 2017/0227208 | A1 | 8/2017 | Bendtsen et al. | |
| 2017/0268730 | A1 | 9/2017 | Cai et al. | |
| 2019/0017659 | A1 | 1/2019 | Dendorfer et al. | |

FOREIGN PATENT DOCUMENTS

| | | | |
|---|---|---|---|
| JP | 2013222782 | A | 10/2013 |
| WO | 2012031533 | A1 | 3/2012 |

* cited by examiner

GLASS LAMPS CONTAINING COBS WITH INTEGRATED ELECTRONICS

CROSS-REFERENCE TO RELATED APPLICATIONS AND PRIORITY

This patent application claims priority from German Patent Application No. 102017110378.3 filed May 12, 2017, which is herein incorporated by reference in its entirety.

Technical Field

The present invention relates to a LED light fixture as well as a LED lamp with such a LED light fixture.

Prior Art

Because of their high energy efficiency, LED light fixtures for use in LED lamps, in particular in LED retrofit lamps, are growing in popularity as a replacement for conventional light fixtures such as halogen or incandescent lamps. However, by comparison with conventional light fixtures, LED light fixtures have several disadvantages.

Thus LED light fixtures have a significantly poorer emission characteristic and a reduced lighting quality. Known LED light fixtures have, for example, a flicker at a frequency of 100 Hz. Moreover, the solid angle covered is generally significantly smaller than in conventional light fixtures and/or the radiation is spatially very inhomogeneous. Also, a poor mounting or adjustment of the light emitting diode chip inside the LED light fixture can lead to a reduction of the lighting quality.

A further disadvantage is the current size of the LED light fixtures or the LED lamps. Thus, in LED light fixtures, driver electronics are additionally required which are generally accommodated in the base of the LED lamps and/or in connection regions of the LED light fixtures. As a result, conventional LED lamps are designed to be relatively large. The cooling elements necessary for the driver electronics and/or the light emitting diode chips are a further reason for cumbersome and expensive LED light fixtures. However, poor cooling reduces the service life of the LED lamp and the lighting quality.

The document WO 2012/031533 A1 describes a LED lamp in which an omnidirectional emission characteristic is ensured by the use of LED filaments. Moreover, the driver electronics is arranged in the lamp base of the LED lamp. As a result, the LED lamp is relatively large overall.

The document JP 2013-222782 A describes a LED light fixture wherein light emitting diode chips are mounted on a circuit board by means of so-called chip-on-board assembly (COB). However, the emission characteristic of the LED light fixture corresponds to the one-sided Lambertian radiation of the light emitting diode chips and thus is very inhomogeneous. Moreover, the already mentioned 100 Hz flickering occurs.

SUMMARY OF THE INVENTION

Starting from the known prior art, it is an object of the present invention to provide a compact LED light fixture which can be produced cost-effectively. Furthermore, a LED lamp with such a LED light fixture should be provided.

These objects are achieved by a LED light fixture and a LED lamp with the features of the independent claims. Advantageous further embodiments are apparent from the subordinate claims, the description, the drawings and also the exemplary embodiments described in connection with the drawings.

Accordingly, a LED light fixture is proposed, comprising a glass bulb, a light module and an driver electronics for the light module. The light module has at least one light emitting diode chip, which is mounted on a circuit board by means of chip-on-board assembly. The light module and the driver electronics are accommodated in the glass bulb, in particular in an interior space of the glass bulb.

Moreover, the chip-on-board assembly of light emitting diode chips enables the cost-effective production of compact and small electric modules. In this case and in the following, the term "chip-on-board assembly" should be understood as the direct assembly of semiconductor chips on a circuit board, in particular using bonding wires. The chip-on-board assembly takes place preferably with semiconductor chips which are not enclosed and/or with so-called chip-scale components, in which the housing accounts for at most 20% more than the surface area of the bare semiconductor chip.

Thus, due to the introduction of the driver electronics into the glass bulb in combination with the chip-on-board assembly of the light emitting diode chip a compact LED light fixture can be provided cost-effectively.

The light module preferably has a plurality of light emitting diode chips. The light emitting diode chips can for example be serially connected to one another. Furthermore, the LED light fixture can have a plurality of light modules. In a preferred embodiment the LED light fixture contains one single light module with a plurality of light emitting diode chips.

According to a preferred embodiment of the LED light fixture, at least a part of the driver electronics, in particular the entire driver electronics, is mounted on the circuit board by means of chip-on-board assembly. In particular, the driver electronics has electronic components. Preferably at least some of the electronic components, in particular all the electronic components, of the driver electronics are mounted on the circuit board by means of chip-on-board assembly. Alternatively or in addition it is possible that at least a part of the driver electronics is mounted on an additional circuit board. Furthermore, at least some of the electronic components can be surface mounted (surface mounted device, SMD) on the board and/or the circuit board and/or can be electrically conductively connected by means of wired connections to the light emitting diode chip.

According to a preferred embodiment of the LED light fixture, the driver electronics comprises a smoothing capacitor which is parallel-connected to the at least one light emitting diode chip. In the case of a plurality of light emitting diode chips, each light emitting diode chip is preferably parallel-connected to the smoothing capacitor. An energy accumulator is introduced into the system through the smoothing capacitor. As a result, flickering, in particular the 100 Hz flickering, of the light emitted by the at least one light emitting diode chip can be substantially reduced or even completely prevented and so the emission characteristic can be significantly improved.

The smoothing capacitor can be mounted on the board of the driver electronics and/or the circuit board of the light module, in particular by means of surface mounting. Alternatively, the smoothing capacitor can be mounted by means of surface mounting or chip-on-board assembly on the circuit board of the light module or a further board. In the case of surface mounting a laser soldering process is preferably used, so that the use of a reflow oven can be avoided. Furthermore, it is possible that the smoothing capacitor is mounted as a simple clamping capacitor on the circuit board of the light module. Alternatively, the smoothing capacitor can be mounted by means of an electrically conductive glue and/or bonding wires.

If the smoothing capacitor and/or the further electronic components of the driver electronics are mounted on the board (or the circuit board) by means of surface mounting, the smoothing capacitor and/or the electronic components are preferably fed through before the application of the light emitting diode chips and possible encapsulation of the light emitting diode chips with a casting material. Alternatively or in addition, the surface mounting can take place in a common process step with the mounting of electrical connectors for electrical contact of the light module, so that the production of the LED light fixture is further simplified.

The smoothing capacitor can be a ceramic multilayer (chip) capacitor, of which the capacitance is for example in a range of 1 μm. Alternatively, an electrolytic capacitor can be used which makes high capacitances possible.

The driver electronics can comprise a rectifier circuit which is configured in order to convert AC mains voltage into a DC operating voltage of the LED light fixture. It is possible that for the rectifier circuit the light emitting diode chips, in particular exclusively the light emitting diode chips, are used as rectification components. Furthermore, the driver electronics can comprise a transistor which is configured for current regulation and/or current limitation of the current flowing through the light emitting diode chip.

According to at least one embodiment of the LED light fixture, a thickness of the circuit board is at most 400 μm. The thickness is preferably at most 300 μm, particularly preferably at most 200 μm. A small thickness is advantageous in particular for a uniform radiation characteristic. In this case and in the following the thickness of the circuit board is its extent along a vertical direction of the circuit board. The vertical direction runs perpendicularly to the lateral direction of the circuit board along which the latter extends.

In the lateral directions the circuit board has a width and a length extending perpendicularly to the width, which is preferably greater than the width. The circuit board is preferably retained in the glass bulb in such a way that the length extends along an axis of symmetry of the glass bulb. The lateral directions span a front side and a rear side of the circuit board. The light emitting diode chips are mounted on the front side and/or on the rear side.

According to a preferred embodiment of the LED light fixture, the circuit board is designed to be translucent. In other words, at least 50%, preferably at least 70%, of the light emitted by the at least one light emitting diode chip and incident on the circuit board is transmitted through the circuit board.

Suitable materials for the circuit board are, for example, quartz glass ($SiO_2$, thermal conductivity 1.0 W/mK), sapphire ($Al_2O_3$, thermal conductivity 25 W/mK), mullite ceramic (silicate ceramic type C610/620, thermal conductivity 10 W/mK) and/or aluminium nitride (AlN, thermal conductivity 200 W/mK). The thermal conductivity values given in brackets values relate to values of frequently industrially used compositions measured at 20° C. When electrically non-conductive, in particular translucent materials are used for the circuit board, further metal plating may be necessary below the light emitting diode chips and/or further electronic components on the circuit board in order to facilitate electrical contact. For improvement of the aesthetics, a translucent and/or opaque material can be applied below electronic components, which are not the light emitting diode chips, in order thus to reduce the visibility of these electronic components.

In particular in combination with a small thickness, a translucent circuit board facilitates the improvement of the emission characteristic of the LED light fixture. In this case the solid angle covered by the light emitted through the LED light fixture can be increased, so that the typical Lambertian emission characteristic of the light emitting diode chips is homogenised up to the omnidirectional radiation by means of the entire solid angle of $2\pi$.

A further improvement in the emission characteristic can be achieved by a bilateral arrangement of light emitting diode chips on the circuit board, that is to say on the front side and the rear side of the circuit board. In this case two circuit boards equipped on the front side with light emitting diode chips can also be connected to one another in each case on their rear sides which are not so equipped. An electrically conductive connection between the light emitting diode chips on different sides of the circuit board can be provided, for example, by means of clamps, in particular metal clamps, and/or wires, in particular metal wires.

According to at least one embodiment of the LED light fixture, the interior space of the glass bulb is filled with a heat-conducting gas. A heat-conducting gas is understood to be a gas which conducts heat well. In particular, a heat-conducting gas can have a higher thermal conductivity than air. Thus, at room temperature, that is to say at the reference temperature of 20° C. (293.15 K), a heat-conducting gas can have a thermal conductivity of at least 0.05 W/mK, preferably at least 0.10 W/mK and particularly preferably at least 0.13 W/mK. Helium gas (thermal conductivity 0.16 W/mK) and/or hydrogen gas (thermal conductivity 0.18 W/mK), for example, are suitable as heat-conducting gas. Furthermore, a mixture of helium with oxygen may be considered as heat-conducting gas. The absolute pressure of the heat-conducting gas in the interior space can be up to 10 bars, preferably at most 5 bars. The absolute pressure is at least 1 bar, preferably at least 2 bars. The details of the absolute pressure should be understood to relate to room temperature. The use of a high pressure of the heat-conducting gas enables an improved heat removal inside the LED light fixture.

The glass bulb is preferably vacuum sealed. In other words, the glass bulb can be closed and/or fused in such a way that the absolute pressure inside the glass bulb is maintained without external devices, such as for example vacuum pumps. Thus, the glass bulb can enclose a sealed or self-contained volume which forms the interior space. In particular, the glass bulb can be designed to be gas-tight.

The glass bulb can be formed with tempered glass, soft glass and/or quartz glass. The glass bulb is preferably formed with quartz glass and/or tempered glass or consists of at least one of these materials. In this case and in what follows, the term "consists" should be interpreted within the context of production tolerances; that is to say, the glass bulb can have impurities due to manufacturing tolerances. For example, the glass bulb contains at least 99% silicon dioxide. By the use of quartz glass or tempered glass a glass bulb can be provided which can be filled with a gas pressure of up to 30 bars. In contrast to this, a soft glass cannot be filed with high gas pressures (up to a maximum of approximately 1 bar). Furthermore, quartz glass and/or tempered glass have the advantage that these materials are extremely temperature-resistant and, moreover, have very good optical characteristics. Moreover, the thermal conductivity of tempered glass or quartz glass is sufficiently high in order to enable a good dissipation of waste heat generated during operation of the LED light fixture.

Duran glass, aluminosilicate glass and/or borosilicate glass may be considered as tempered glasses. In particular, those glasses which are also used in the construction of conventional halogen lamps are suitable as tempered glasses. The glass bulb can be constructed in the manner of a glass bulb of a conventional halogen lamp. In contrast to soft glasses, in which a temperature shock of 100 K can already lead to rupture or cracking of the glass lead, quartz glass and also tempered glass can be exposed to high temperatures, for example up to 1000 K, without ruptures or cracks occurring.

Furthermore, the glass bulb can contain a getter material for setting (so-called degettering) of volatile organic compounds (VOC) and/or volatile compounds containing sulfur, phosphorus and/or chlorine. In particular, the volatile organic compounds can include oxygen, nitrogen, hydrogen and/or carbon. The getter material can be introduced into the glass bulb in the solid and/or gaseous state. The volatile organic compounds and/or compounds containing sulfur, phosphorus and/or chlorine can also be generally designated below as "volatile compounds".

In closed glass bulbs in the case of LED light fixtures with light emitting diode chips and/or further components, the problem of outgassing of volatile organic compounds can increasingly occur. To some extent this is due to the fact that the glass bulb of the LED light fixture is designed to be relatively small because of the higher mechanical loading by the high pressure. Similarly to the technology of the conventional halogen lamp, in which due to the smaller bulb any evaporating tungsten compounds can be degettered by halogen compounds, degettering of volatile compounds can also occur in small closed glass bulbs for LED light fixtures with light emitting diode chips.

The volatile compounds can originate, for example, from fluxing agent residues or solder resists from soldering processes. Furthermore, the volatile compositions can be outgassing of polymers of the light emitting diode chips, glues and/or heat conducting pastes. Moreover, the volatile compounds can originate from the circuit board.

Volatile organic compounds present in the glass bulb can be deposited on the material of the glass bulb where they lead to discolorations. This is known under the term "fogging" of the glass bulb and can lead to losses of luminous flux of up to 10%. The diffusion of the volatile organic compounds into a silicone shell which may be present on the light emitting diode chip is even more serious. As a result, hydrocarbon compounds in the silicone shell are broken up and the silicone can take on a dark colour. This can lead to losses of luminous flux of over 50%. This loss of luminous flux is generally associated with an additional colour location shift. These two phenomena are known under the terms "lumen degradation" and "change colour chromaticity". Furthermore, compounds containing sulfur, phosphorus and/or chlorine can lead to reflection losses on a silver mirror which may be present below the emitting layers of the light emitting diode chips.

The getter material is preferably introduced at least partially as gas into the glass bulb. The gaseous getter material is, for example, hydrogen-rich and/or oxygen-rich compounds, which preferably bind volatile carbon-containing compounds and, for example, react to $CH_4$ or $CO/CO_2$. Due to the binding a reaction with a silicone shell and/or a deposition on the glass bulb can be prevented. In particular, the getter material can contain oxygen gas and/or a silane, for example a monosilane ($SiH_4$). In this case because of the high pressure inside the gas bulb it may be possible to introduce the silane at a maximum concentration below an ignition limit or explosion limit. For example, the bulb can be filled with 8% by volume of silane. In particular, the quantity of gaseous getter material can be increased in direct proportion to the absolute pressure of a heat-conducting gas optionally introduced into the glass bulb.

Alternatively, or in addition, the getter material can be introduced at least partially into the glass bulb as solid material. Than firmly getter material is suitable for example A pure metal, such as zirconium Zr, tantalum Ta, titanium Ti, Palladium Pd, vanadium V, aluminium Al, copper Cu, silver Ag, magnesium Mg, nickel Ni, iron Fe, calcium Ca, strontium Sr and barium Ba, or also alloys of pure metals, such as for example ZrAl, ZrTi, ZrFe, ZrNi, ZrPd and/or $BaAl_4$, are suitable, for example as solid getter material. In this case the use of a ZrAl alloy is preferred. Furthermore, oxides and hydrides of pure metal are suitable as getter material. Metal hydroxides, such as for example magnesium hydroxide or aluminium hydroxide, may be considered in particular as solid getter materials inside the glass bulb. Metal hydroxides are suitable, for example, for degettering of volatile carbon compounds in the closed volume of the glass bulb.

Solid getter materials are preferably applied so that they have a large reactive surface, such as for example as a coating and/or as sintering material. Alternatively or in addition, the getter material can be introduced into the glass bulb as solid metal, for example in wire form.

In this connection it is possible that solid getter materials are optimised with regard to their getter behaviour by additionally introduced gaseous getters. For example, the getter materials can be activated after a pumping operation and firing in the furnace (tempering). As a result, for example, reactive oxides of metallic getter materials can form.

According to at least one embodiment of the LED light fixture, the circuit board is thermally coupled to the glass bulb. Alternatively or in addition, the smoothing capacitor is thermally coupled to the glass bulb. Preferably, the smoothing capacitor is mounted on the circuit board and is thermally coupled, together with the circuit board, to the glass bulb. In this case and in what follows, "thermally coupled" means that the circuit board or the smoothing capacitor is thermally conductively connected to the glass bulb. In particular, the circuit board and/or the smoothing capacitor can be in direct contact with the glass bulb at some points. This enables efficient cooling of the at least one light emitting diode chip or the smoothing capacitor mounted on the circuit board and consequently a constant lighting quality in conjunction with an increased duration of operation.

According to at least one embodiment of the LED light fixture, the glass bulb has a dimple, preferably a plurality of dimples. The dimple protrudes into the interior space of the glass bulb. In other words, the dimple is concave with respect to the interior space. The dimple is in thermal contact with the circuit board and/or the smoothing capacitor. The dimple preferably borders directly on the circuit board and/or the smoothing capacitor. In the production of the LED light fixture the dimple can be formed, for example, by pressing in and/or compressing the material of the glass bulb which is still soft.

The thermal conduction between the glass bulb and the circuit board with the light emitting diode chips and/or the smoothing capacitor can be further improved by means of the dimple. In this case it is advantageous if the dimple is in thermal contact with temperature-sensitive (opto-)electronic components. Moreover, the dimple can mask the direct view of electronic components in the interior space of the glass bulb and thus can improve the aesthetic visual appearance of the LED light fixture. This is advantageous in particular when the dimple borders directly on the smoothing capacitor, since this latter can be unattractive, for example because of its size.

According to at least one embodiment of the LED light fixture, the glass bulb has two dimples opposite one another and the circuit board is clamped between the two dimples. Thus the dimples fix the circuit board inside the glass bulb. A distance between the dimples then corresponds preferably to the thickness of the circuit board. However, further components can also be arranged between the circuit board and the dimples, so that the distance between the dimples can also be greater than the thickness of the circuit board.

In particular, the dimples can be formed in mirror symmetry relative to one another with respect to an axis of symmetry of the glass bulb. In this case the dimples centre the circuit board in the glass bulb. The circuit board then runs along the axis of symmetry. In this case and in what follows, the axis of symmetry of the glass bulb can extend along the main extension direction of the glass bulb. For example, the glass bulb has a cylindrical or elongated, in particular rounded, cuboid shape, wherein the axis of symmetry is then the height of the cylinder or the length of the cuboid.

Thus, due to dimples on both sides, which are in thermal contact with the circuit board, on the one hand the heat removal can be improved and homogenised and on the other hand the mechanical retention of the circuit board, in particular a heavy circuit board, inside the glass bulb can be enhanced. Thus, in particular, in the case of centring of the circuit board by the glass bulb, the aesthetic visual appearance can be further improved. Furthermore, the mechanical stability of the lamp in the so-called postal drop test according to DIN ISO 2206 or DIN ISO 2248 (respective version at the time of the application) can be improved. The postal drop test simulates the maximum mechanical loads during the transport of the lamp. Without the dimples the respective bending moments on the wire sections of the holder and/or the glass pinch during transport can be very high.

The dimples are preferably located on a top side of the glass bulb which lies opposite a holder of the light module. The holder of the light module is located on the bottom side of the glass bulb, in particular together with electrical connectors of the light module. The holder can correspond in particular to the electrical connectors. The electrical connectors can be, for example, wire pins. The wire pins can be soldered and/or clamped to the circuit board. On a side remote from the circuit board the wire pins can be fused with the glass bulb, so that a mechanical retention of the circuit board is ensured. If the dimple is located on the top side, by the clamping of the circuit board it is possible to reduce the mechanical loads, in particular the mechanical stress, on the holder and, moreover, to prevent distortion or breaking off of the light module due to shaking of the LED light fixture. In the case of one single dimple, this can likewise be located on the top side of the glass bulb remote from the holder.

For electrical contacting of the light module from the exterior, the electrical connectors can be connected by means of an electrically conductive connection region to contact pins arranged at least partially outside the glass bulb. The connection region can be fused or welded to the glass bulb. The fusion can take place in particular in such a way that the glass bulb is vacuum sealed. For example, a molybdenum film and/or a molybdenum wire is attached between the glass bulb and the connection region, in particular in a fusion region of the connector, in order thus to simplify the fusion. The molybdenum film or the molybdenum wire is formed with molybdenum or consists of molybdenum. Furthermore, the molybdenum film or the molybdenum wire can contain a getter material, for example in the form of a coating.

In the case of a quartz glass bulb a molybdenum film is preferably used and in the case of a tempered glass bulb a molybdenum wire is preferred. This is due to different coefficients of thermal expansion of quartz glass and tempered glass. Thus the thermal coefficient of expansion of molybdenum is $5.1 \cdot 10^{-6}\ K^{-1}$, of quartz glass $0.6 \cdot 10^{-6}\ K^{-1}$ and of tempered glass $4.7 \cdot 10^{-6}\ K^{-1}$. Thus, tempered glass has a similar coefficient of thermal expansion to molybdenum (the difference is less than 10%), and for this reason in contrast to quartz glass a direct fusion is possible. Alternatively, in the case of tempered glass a wire with an iron-nickel-cobalt alloy (so-called KOVAR) and/or a tungsten wire can be used.

Furthermore, transition glasses can be attached between the glass bulb and the connection region. Moreover, it is possible that the connector and/or any retaining wires provided for a circuit board consist of a getter material or are coated with a getter material. The above-mentioned solid getter materials are, for example, suitable for this purpose.

According to at least one embodiment of the LED light fixture, the glass bulb has a notch which protrudes into the interior space of the glass bulb, extends along an axis of symmetry of the glass bulb and is configured for centring of the light module inside the glass bulb. For example, the notch serves for clamping the circuit board on an edge of the circuit board opposite the holder of the circuit board.

According to at least one embodiment of the LED light fixture the circuit board has a width which corresponds substantially to the greatest internal diameter of the glass bulb. In this case "substantially" should be understood in such a way that the width can deviate by up to +/−20%, preferably +/−10%, from the greatest internal diameter. Both the greatest internal diameter and also the width of the circuit boards extend perpendicularly to the axis of symmetry of the glass bulb. The glass bulb preferably has a cylindrical shape with an elliptical or circular cross-section; in this case the greatest internal diameter is the large axis of the ellipse or the diameter of the circle. Alternatively, the glass bulb can have the shape of a cuboid, in particular a rounded cuboid, with a rounded rectangular cross-section; in this case the greatest internal diameter is the longer side of the rectangular cross-section. Due to the similar dimensions of the greatest internal diameter of the glass bulb and the width of the circuit board, the circuit board can be clamped and retained by means of the walls of the glass bulb. In this case further materials can be located between the circuit board and the glass bulb, so that a thermal coupling of the circuit board to the glass bulb and/or compensation for geometric deviations due to manufacturing tolerances is made possible.

According to at least one embodiment of the LED light fixture, the glass bulb has a convexity with respect to the interior space of the glass bulb. The circuit board and/or the smoothing capacitor is/are at least partially received in the convexity. The convexity can be the glass lug which is known from conventional halogen lamps and can serve for filling of the glass bulb with a heat-conducting gas. Due to the convexity the design of the LED light fixture can be brought closer to that of a conventional halogen lamp, so that the aesthetics and the customer acceptance is increased.

Furthermore, the convexity can serve for centring and/or at least partial fixing of the light module inside the glass bulb.

According to at least one embodiment of the LED light fixture the circuit board and/or the smoothing capacitor is/are at least partially embedded in a mechanically flexible cast body. The cast body can in particular be a silicone encapsulation. Mechanical flexibility is provided, for example, when the cast body can be compressed non-destructively by at least 30% of its dimensions and/or when the cast body is resilient. The cast body can be mounted, in particular, on the points on the circuit board and/or on the smoothing capacitor which are located on the dimple and/or the notch. In general, the cast body makes it possible to compensate for tolerances due to manufacturing tolerances in the dimensions of the circuit board, the smoothing capacitor and/or the glass bulb. For example, when the cast body is clamped between two dimples in the event of a thick circuit board the cast body is compressed, that is to say resiliently deformed, more intensively than in the case of a thinner circuit board. Similarly, a reduction of the greatest internal diameter of the glass bulb can be compensated for by an encapsulation of the edges of the circuit board with the casting material equalised, since this material is then compressed during clamping of the circuit board in the glass bulb. Alternatively or in addition, the cast body can be mounted on the at least one light emitting diode chip. In this way it is possible to adapt the emission characteristic of the light emitting diode chip. For example, the cast body contains diffuser particles and/or wavelength-converting particles. Furthermore, the cast body can be in the form of a lens. In particular if the cast body contains wavelength-converting particles, the smoothing capacitor can likewise be mounted below the cast body, so that the direct view of the smoothing capacitor is obstructed. In this way the aesthetic visual appearance of the LED light fixture can be further improved.

According to at least one embodiment of the LED light fixture, the glass bulb is frosted and/or matt. The glass bulb is preferably made of frosted glass and/or a matt glass. For example, the glass bulb has been treated by sand blasting for this purpose. Due to the use of frosted glass the solid angle range covered by the LED light fixture can be further increased and the emission characteristic can be improve.

For improvement of the aesthetics of the LED light fixture it is also possible that the light module comprises different sections, wherein the sections of the light module radiate light with colour temperatures which differ from one another. Alternatively or in addition, it is possible that the LED light fixture comprises a plurality of light modules which radiate light with colour temperatures which differ from one another.

For example, the LED light fixture contains a first section which emits in particular white light with a first colour temperature, and a second section which emits in particular white light with a second colour temperature which is higher than the first colour temperature. The colour temperature or the colour point of the light emitted by the LED light fixture is then predetermined by the respective colour temperatures or colour points of the light emitted by the individual sections and/or light modules.

For example, the first section and the second section can in each case comprise at least one light emitting diode chip which emits blue light, wherein the blue light is converted into white light by means of a wavelength conversion element which comprises the wavelength-converting particles, in particular a phosphorus. The wavelength conversion element of the first section can comprise different wavelength-converting particles from the wavelength conversion element of the second section and/or different compositions of the wavelength-converting particles, so that in the first section light is emitted with a different colour temperature from the second section. The use of different wavelength conversion elements can also be applied analogously for the case of a plurality of light modules. Furthermore, more than two sections, in each case with different wavelength conversion elements, can be used.

The second section can be located nearer to the top face of the glass bulb than the first section. Furthermore, it is possible that the sections can be electrically separately controlled and/or dimmed. In particular, during dimming the light emitting diode chips of a section can be dark (i.e. they emit less light than in the different section), so that the colour point of the light which is emitted overall by the LED light fixture is changed. Due to this arrangement, for example during dimming of the LED light fixture, a dimming effect similar to that of an incandescent lamp can be achieved in particular by means of phase section dimming.

Furthermore, a LED lamp is specified. The LED lamp comprises an enclosure and a LED light fixture arranged inside the enclosure. The LED light fixture of the LED lamp is preferably a previously described LED light fixture. In other words, all features described for the LED light fixture are also described for the LED lamp, and vice versa. The LED lamp can be, for example, a LED retrofit lamp or a LED luminaire.

The enclosure can be a glass shell and/or an at least partially translucent housing. In particular, the enclosure is formed with a material which has a high thermal conductivity which, in particular, corresponds at least to the thermal conductivity of quartz glass.

The enclosure of the LED lamp is preferably a glass shell. A heat-conducting gas can be located in an intermediate space between the glass shell and the glass bulb. The pressure of the heat-conducting gas inside the glass shell is preferably lower than the pressure of the heat-conducting gas inside the glass bulb. For example, the pressure in the glass shell is at least 0.5 bar, preferably at least 1 bar lower than in the glass bulb. The pressure in the glass shell is preferably 1 bar. Alternatively or in addition, a heat-conducting material, such as for example a silicone encapsulation and/or glass diffusers, can be introduced into the intermediate space between the glass bulb and the enclosure.

The glass shell is preferably formed with or made from a soft glass, in particular soda-lime glass. Soft glass is characterised by its low production costs and easy workability.

Alternatively or in addition, the enclosure can comprise a reflector which is reflective for the light emitted by the LED light fixture. The LED lamp can then be designed, in particular, as a retrofit for a conventional halogen reflector lamp.

The LED light fixture described here is particularly compact and cost-effective to produce. The emission characteristic is substantially improved by comparison with known LED light fixtures.

BRIEF DESCRIPTION OF THE DRAWINGS

Preferred further embodiments of the invention are explained in greater detail by the following description of the drawings.

FIGS. 1A, 1B, 10, 2A, 2B, 2C, 3A and 3B show exemplary embodiments of a LED light fixture described here as well as light modules for a LED light fixture described here.

DETAILED DESCRIPTION OF PREFERRED EXEMPLARY EMBODIMENTS

Figure 1A:
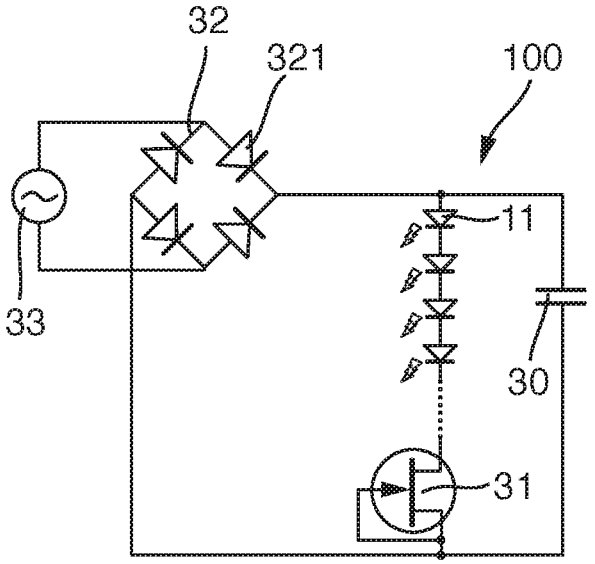

The light fixture described here as well as the LED lamp described here are explained in greater detail below with reference to exemplary embodiments and the associated drawings. In this case elements which are the same, of the same kind, similar or equivalent are provided with the same reference numerals. Repeated description of some of these elements is omitted in order to avoid redundancies.

The drawings and the size ratios of the elements illustrated in the drawings elements should not be regarded as drawn to scale relative to one another. On the contrary, individual elements may be shown as excessively large for better illustration and/or to aid understanding.

A first exemplary embodiment of a LED light fixture 1 described here is explained in greater detail with reference to the schematic illustrations in FIGS. 1A, 1B and 1C. The illustrated LED light fixture 1 can be used as a LED lamp, for example in a so-called pin-base lamp, in particular a G9 pin-base lamp which can be operated at 230 V. In this case FIG. 1A shows a circuit diagram of a light module 100 for the LED light fixture 1, FIG. 1B shows a schematic sketch of the light module 100 for the LED light fixture 1, and FIG. 1C shows a schematic sketch of the LED light fixture 1.

The light module 100 comprises a plurality of light emitting diode chips 11. In fact, four light emitting diode chips 11 are shown in the example. However, unlike the illustration in FIG. 1A, the light module 100 can also have more or fewer light emitting diode chips 11. The light emitting diode chips 11 are series-connected to a transistor 31. The transistor 31 can serve for example for setting a current through the series-connected light emitting diode chips 11. A smoothing capacitor 30 is parallel-connected to the light emitting diode chips 11. The smoothing capacitor 30 serves for filtering modulations, in particular at 100 Hz, in the operating voltage of the light emitting diode chips 11. The operating voltage is provided by a voltage source 33. Between the voltage source 33 and the light emitting diode chip 11 is located a rectifier circuit 32, which in the present case is formed with four diodes 321. The rectifier circuit 32 and the transistor 31 can be part of an driver electronics, which can be mounted inside the glass bulb 20 of the LED light fixture 1.

Figure 1B:
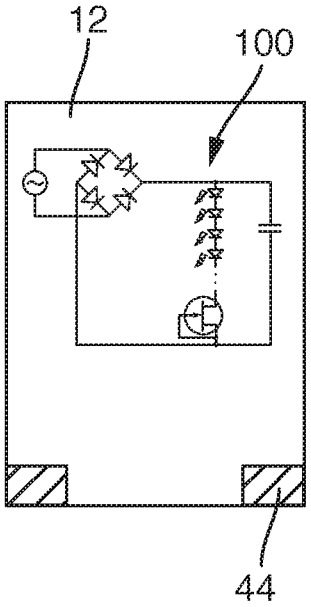
Figure 1C:
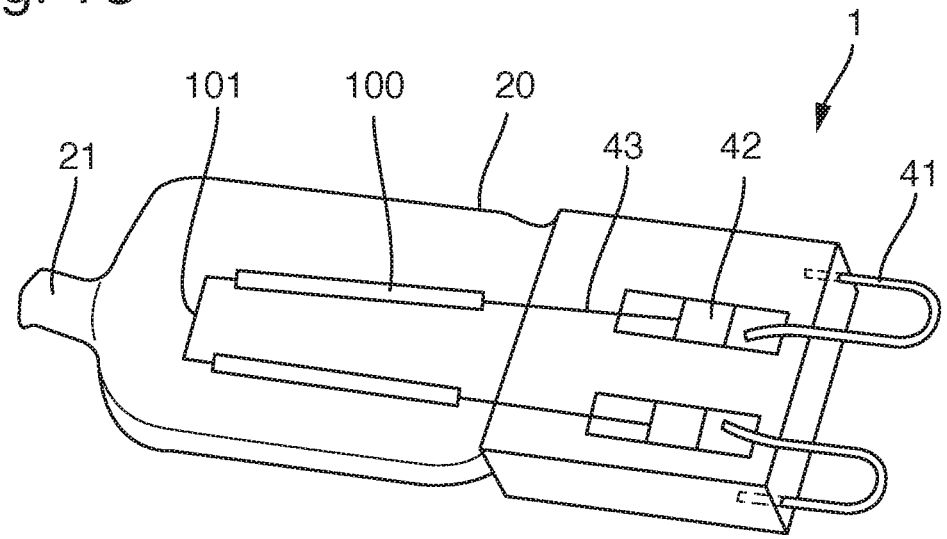

In FIG. 1B the electronic components of FIG. 1A are illustrated schematically together on a circuit board 12. Alternatively it is possible that at least some of the components of the light module 100 is mounted on a separate board. Preferably at least light emitting diode chips 11 of the light module 100 are mounted on the circuit board 12 by means of chip-on-board assembly. The electric contacting of the light module 100 takes place by means of contact points 44 which are located on the circuit board 12.

In the case of a G9 pin-base lamp the circuit board 12 preferably has a width of at least 5 mm and at most 11 mm. The length preferably amounts to at least 10 mm and at most 30 mm. The contact points 44 are spaced 6 mm apart from one another.

FIG. 10 shows a LED light fixture 1 which can contain a light module 100 described in connection with FIGS. 1A and 1B. The light module 100 of the LED light fixture 1 is illustrated purely by way of example as an incandescent filament of a conventional halogen lamp. In this case the LED light fixture 1 comprises two light modules 100. However, in a preferred embodiment of the LED light fixture 1—contrary to the illustration in FIG. 1C—only one light module 100 is provided. The light modules 100 are located in a glass bulb 20. The glass bulb 20 further comprises electrical connectors 43 which are electrically conductively connected to the contact points 44 of the light module 100. The position of the electrical connectors 43 defines a bottom side of the glass bulb 20.

On a top side opposite the bottom side the glass bulb 20 has a convexity 21. The convexity 21 is arranged on an axis of symmetry of the glass bulb 20. A part 101 of the light module 100 protrudes into the convexity 21 and as a result can be centred by means of the convexity 21.

The electrical connectors 43 are electrically conductively connected to contact pins 41 by means of a connection region 42. A molybdenum film is located in the connection region 42, and when this film is used it is possible to compensate for a different thermal coefficient of expansion of the material of the electrical connectors 43 or the contact pins 41 and the material of the glass bulb 20. In particular, in the illustrated example the glass bulb 20 can be formed with quartz glass. Alternatively, in the case of tempered glass it is possible that the connection region 42 merely comprises a wire, for example a molybdenum wire, a tungsten wire or an iron-nickel-cobalt wire, since with tempered glass in conjunction with the said electrically conductive materials no adaptation of the coefficients of thermal expansion is necessary.

A further exemplary embodiment of a LED light fixture 1 described here is explained in greater detail with reference to the schematic illustrations in FIGS. 2A, 2B and 2C. The illustrated LED light fixture 1 can also be used as a LED lamp, for example in a so-called pin-base lamp, in particular a G4 pin-base lamp which can be operated at 12 V. In this case FIG. 2A shows a circuit diagram of a light module 100 for the LED light fixture 1, FIG. 2B shows a schematic sketch of the light module 100 for the LED light fixture 1, and FIG. 1C shows a schematic sketch of the LED light fixture 1.

Figure 2A:
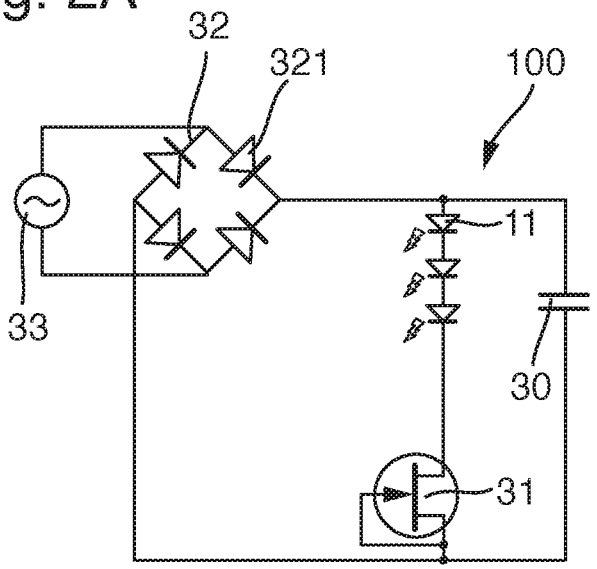

In contrast to the light module 100 of FIG. 1A the light module 100 of FIG. 2A merely comprises three light emitting diode chips 11. The rest of the configuration does not differ from the light module 100 of FIG. 1A. Due to the reduction in the number of light emitting diode chips 11 it is also possible to operate the light module 100 at low voltages, in particular at 12 V.

Figure 2B:
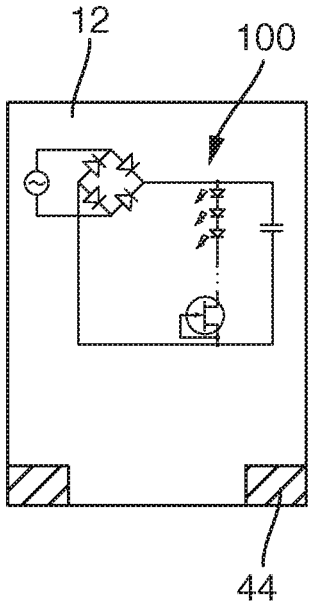

FIG. 2B shows a schematic illustration of the electronic components of FIG. 2A mounted on a circuit board 12. For the remaining components the layout corresponds to that of FIG. 1B. In the case of a G4 pin-base lamp the circuit board 12 preferably has a width of at least 5 mm and at most 10 mm and a length of at least 5 mm and at most 20 mm. The contact points 44 are spaced 5 mm apart from one another.

Figure 2C:
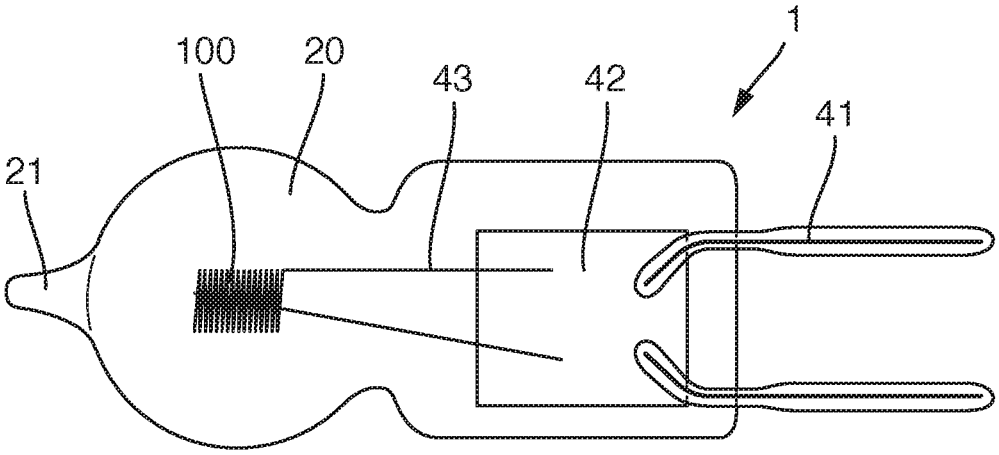

FIG. 2C shows a LED light fixture 1 which can contain the light module 100 described in connection with FIGS. 2A and 2B. The light module 100 of the LED light fixture 1 is illustrated purely by way of example as an incandescent coiled filament. However, the light module 100 comprises the light emitting diode chips 11 of FIGS. 2A and 2B mounted on a circuit board 12 by means of chip-on-board assembly. The LED light fixture 1 differs from the LED light fixture 1 of FIG. 10 in particular by a partially spherical structure of the glass bulb 20 due to a more pronounced convexity 21. As a result, the LED light fixture 1 is even more similar to a conventional halogen or incandescent lamp.

Of course, the LED light fixture 1 of FIG. 10 can also be equipped with the light module 100 of FIGS. 2A and 2B and vice versa.

Figure 3A:
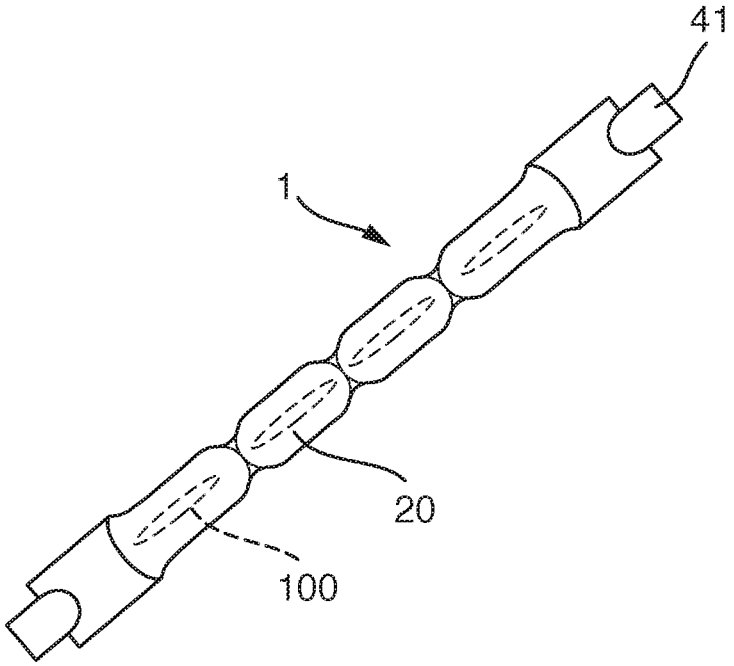
Figure 3B:
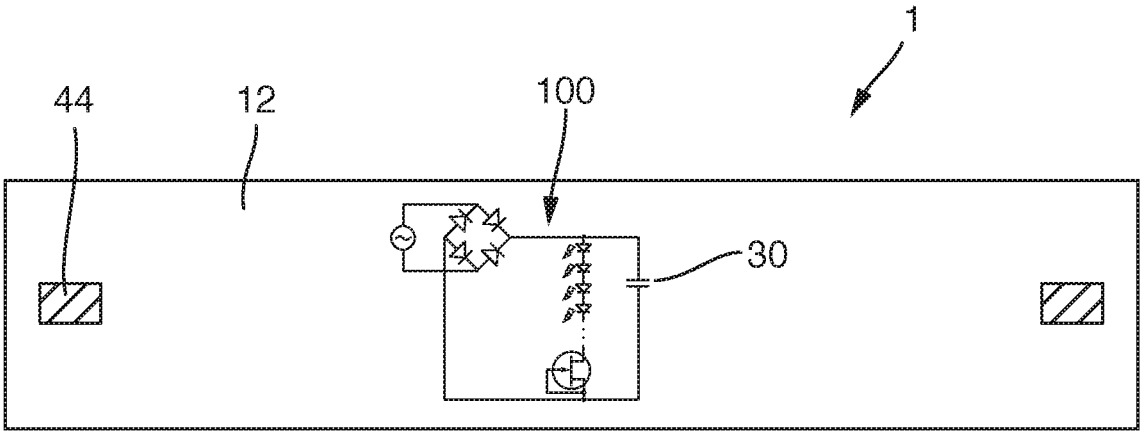

A further exemplary embodiment of a LED light fixture 1 described here is explained in greater detail with reference to the schematic illustrations in FIGS. 3A and 3B. The illustrated LED light fixture 1 can be designed for example as a halogen tubular lamp. The LED light fixture 1 has an elongated, rod-like shape. Both the light module 100 described in connection with FIG. 1A and the one described in connection with FIG. 2A can be used as the light module 100. Because of the elongated shape the circuit board 12 should likewise be elongated. The circuit board 12 preferably has a width of 5 mm and a length of at least 50 mm and at most 100 mm.

In contrast to the LED light fixtures 1 of FIGS. 1A to 2C, in which the contact pins 41 were arranged on the same side of the glass bulb 20, the contact pins 41 are now arranged on opposite sides of the glass bulb 20. The contact points 44 are preferably also mounted on opposing sides of the circuit board 12 (see FIG. 3B).

Exemplary embodiments of a LED lamp described here is explained in greater detail with reference to the schematic illustrations in FIGS. 4A, 4B and 4C. The LED lamps are in each case designed as LED retrofit lamps. Each of the LED lamps comprises a LED light fixture 1 as well as an enclosure 60. Furthermore, bases 62 for introduction of the LED lamp into a lamp socket and for electrical contacting of the LED lamp are provided.

Figure 4A:
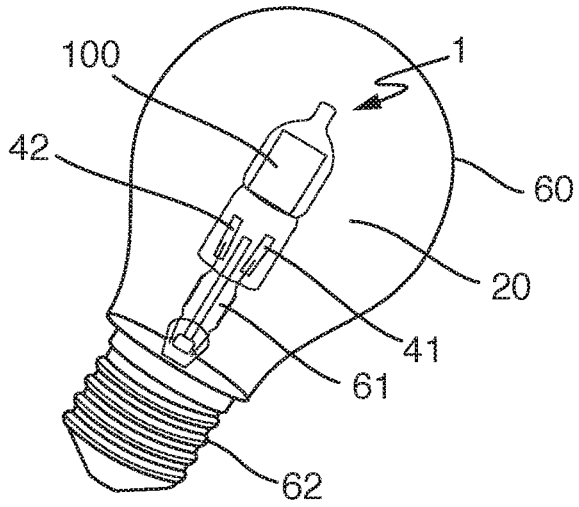
FIGS. 4A, 4B and 4C show exemplary embodiments of a LED lamp described here.

In the LED lamp of FIG. 4A the enclosure 60 is a glass shell which preferably corresponds to the glass shell of a conventional light bulb. In FIG. 4A the enclosure 60 is pear-shaped. Alternatively the enclosure 60 can be cylindrical. A heat-conducting gas is preferably introduced between the enclosure 60 and the glass bulb 20 of the LED light fixture 1. The LED light fixture 1 is connected by means of two mounting wires 61 to the base 62. The mounting wires 61 serve on the one hand to hold the LED light fixture 1 and on the other hand produce an electrically conductive connection between the base 62 and the contact pins 41 of the LED light fixture 1.

Figure 4B:
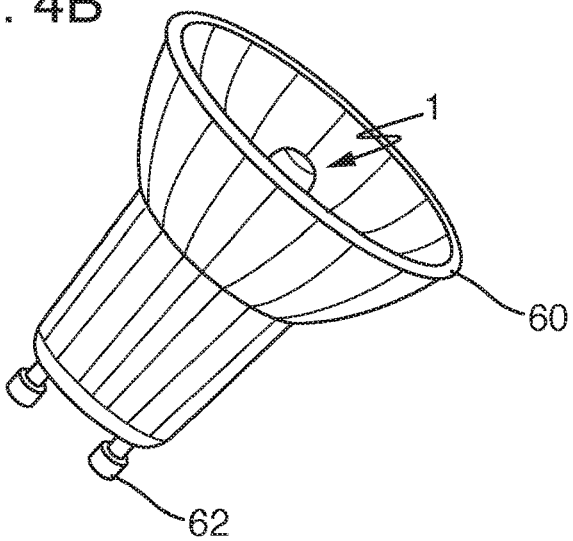
Figure 4C:
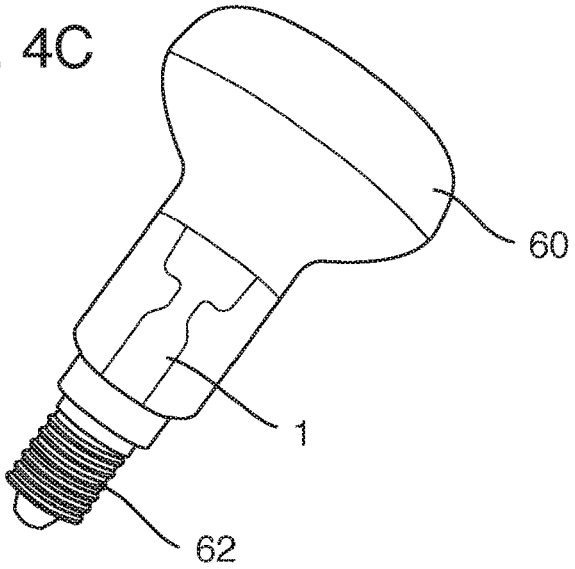

The LED lamp of FIG. 4B comprises an enclosure 60 which is designed as a reflector of a (halogen) reflector lamp. The LED light fixture 1 (not visible in FIG. 4B) is located in a cavity of the enclosure 60. The enclosure 60 of the LED lamp of FIG. 4C is formed with a glass shell which in part has a reflecting coating to form a reflector. The enclosures 60 of the LED lamps of FIGS. 4B and 4C can likewise contain a heat-conducting gas in an intermediate space between the enclosure 60 and the LED light fixture 1.

Exemplary embodiments of a light module 100 for a LED light fixture 1 described here are explained in greater detail with reference to the schematic illustrations in FIGS. 5A to 5E. A circuit board 12 with contact points 44 and electrical connectors 43 electrically conductively connected thereto is illustrated sketchily in each case in FIGS. 5A to 5E. The light emitting diode chips 11 as well as the electronic components, in particular the smoothing capacitor 30, of the light module 100 (not shown in FIGS. 5A to 5E) are located on the circuit board 12. The light modules 100 of FIGS. 5A to 5E differ through by the electrical contacting of the contact points 44.

Figure 5A:
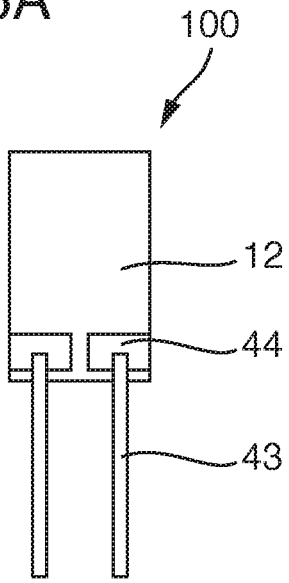
FIGS. 5A, 5B, 5C, 5D and 5E show exemplary embodiments of a LED light module described here.

In the exemplary embodiment of FIG. 5A the electrical connectors 43 are formed as wires which are soldered to the contact points 44. A high-temperature solder (melting temperature above 400° C.) in conjunction with a wire and contact points, which in each case have a high melting temperature, is preferably used for the soldering. In particular, the melting temperature of the solder, the wire and the material of the contact points 44 is at least 1800° C. Coated or uncoated molybdenum, niobium, tantalum and/or stainless steel, for example, are suitable as such high-temperature materials. By the choice of such a material it can be ensured that the mechanical connection between the electrical connectors 43 and the contact points 44 during fusion of the glass bulb 20 around the electrical connectors 43 is not broken by the heat evolution associated therewith.

Figure 5B:
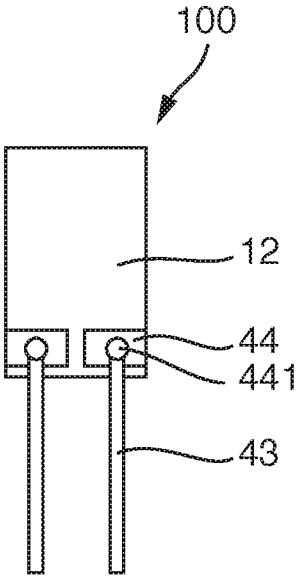

In the exemplary embodiment of FIG. 5B the electrical connectors 43 formed as wires are connected to the contact points 44 by means of rivets 441. For the riveting 441 holes are introduced into the contact points 44 and the electrical connectors 43 are riveted to the contact points 44 by means of a riveting tool. The contact points 44 and the electrical connectors 43 are preferably formed from one of the previously described high-temperature materials.

Figure 5C:
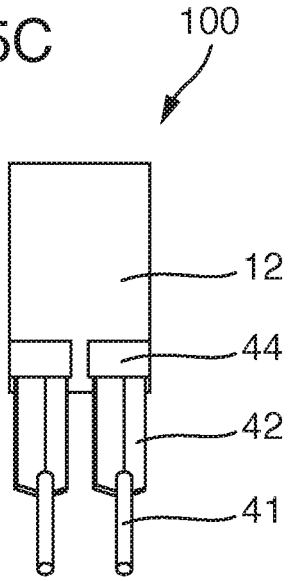

In contrast to the preceding light modules 100, the light module 100 of FIG. 5C has no electrical connectors 43. Instead, a connection region 42 formed as a molybdenum film is connected directly to the contact points 44. The molybdenum film is in particular soldered directly to the contact points 44, so that material savings can be made. For mechanical stabilisation of the thin foil and/or for improvement of the soldering or welding properties this film can be coated, for example with ruthenium. The use of a molybdenum film instead of a wire is advantageous in particular in the case of quartz glass.

Figure 5D:
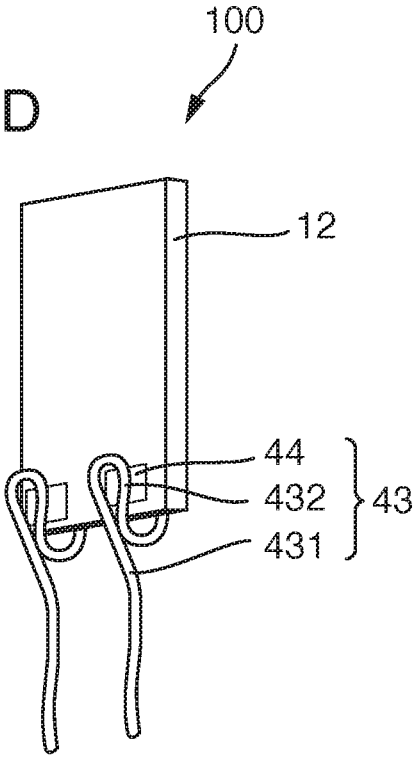

In the exemplary embodiment shown in FIG. 5D the electrical connectors 43 have first connection regions 431 and second connection regions 432. In this case the electrical connectors 43 can be constructed as wires which are soldered onto the contact points 44. The second connection regions 432 are doubly curved. As a result it is possible for the contact points 44 mounted on the front side of the circuit board 12 shown in FIG. 5D to be electrically conductively connected to further contact points (not illustrated in FIG. 5D) which are mounted on the rear side of the circuit board 12 remote from the front side. This is advantageous, in particular, if both sides of the circuit board 12 are equipped with light emitting diode chips 11, since the light emitting diode chips 11 on the front side and the light emitting diode chips 11 on the rear side can be contacted in each case by a wire as electrical connector 43.

Figure 5E:
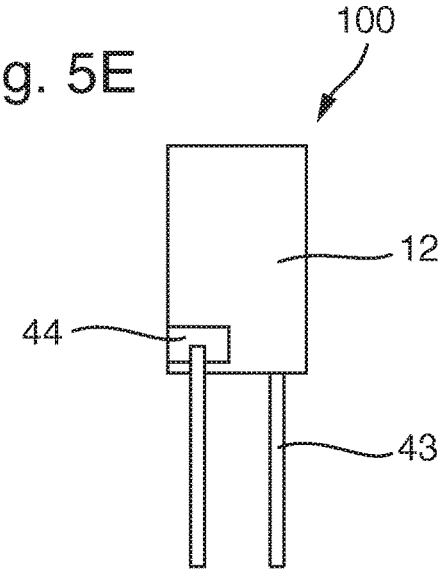

FIG. 5E shows an exemplary embodiment of a light module 100, in which a contact point 44 is mounted on the front side of the circuit board 12 and the second contact point 44 is mounted on the rear side of the circuit board 12 remote from the front side (not visible in FIG. 5E). This arrangement is advantageous, for example, for equipping the circuit board 12 on both sides with light emitting diode chips 11. For example, the electrical connectors 43 can be soldered onto the contact points 44.

The exemplary embodiments of FIGS. 5A to 5E can be combined with one another. For example, the connection region 42 illustrated in FIG. 5C can be used in connection with one of the electrical connectors 43 of FIG. 5A, 5B, 5D or 5E and/or the two connection regions 431, 432 of FIG. 5D are connected to the contact points 44 by means of the riveting 441 of FIG. 5B.

Figure 6A:
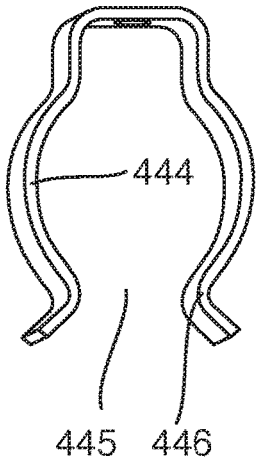
FIGS. 6A, 6B and 6C show exemplary embodiments of metal clamps for a LED light fixture described here.
Figure 6B:
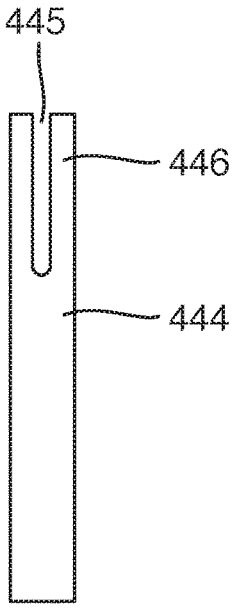
Figure 6C:
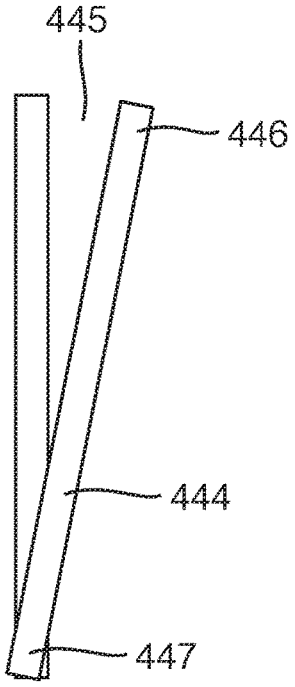

FIGS. 6A, 6B and 6C in each case show metal clamps 444 for transmission of an electrical contact from the front side of the circuit board 12 to the rear side of the circuit board 12. Such metal clamps 444 can be used in conjunction with the light modules 100 shown in FIGS. 5A to 5E, in particular if contact points 44 are mounted both on the front side and also on the rear side of the circuit board 12. The metal clamps 444 are in each case made from an electrically conductive material, such as for example stainless steel.

The metal clamps 444 in each case have contact regions 446 and an opening 445 which is formed for introduction of the circuit board 12. A diameter of the opening 445 corresponds substantially to the thickness of the circuit board 12. The circuit board 12 is clamped into the opening 445 and the contact regions 446 in direct contact with the contact points 44, so that an electrical contact is produced between contact points 44 on the front side and contact points 44 on the rear side of the circuit board 12.

The metal clamp 444 of FIG. 6A is constructed like a spring and has a curved region which facilitates clamping. The metal clamp 445 of FIG. 6B is planar on its outer sides remote from the opening 445, so that the metal clamp 445 can be extremely narrow.

In the case of the metal clamp 444 of FIG. 6C, two wire tracks, which can be formed in particular as protective conductors, have been arranged at an angle relative to one another and welded to one another at a connection point 447. As a result, a metal clamp 444 can be provided in a simple manner.

Further exemplary embodiments of a LED light fixture 1 described here are explained in greater detail with reference to the illustrations in FIGS. 7A to 7E.

Figure 7A:
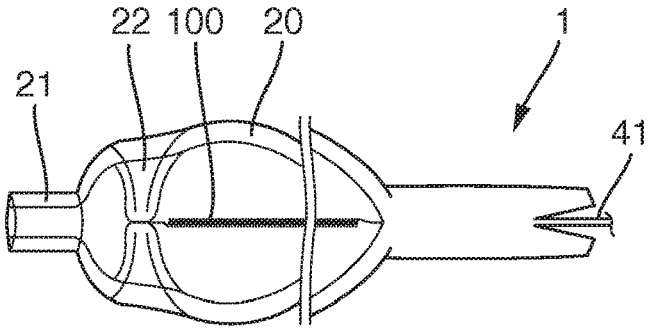
FIGS. 7A, 7B, 7C, 7D, 7E, 8A, 8B, 9A, 9B, 10A and 10B show exemplary embodiments of a LED light fixture described here.
Figure 7B:
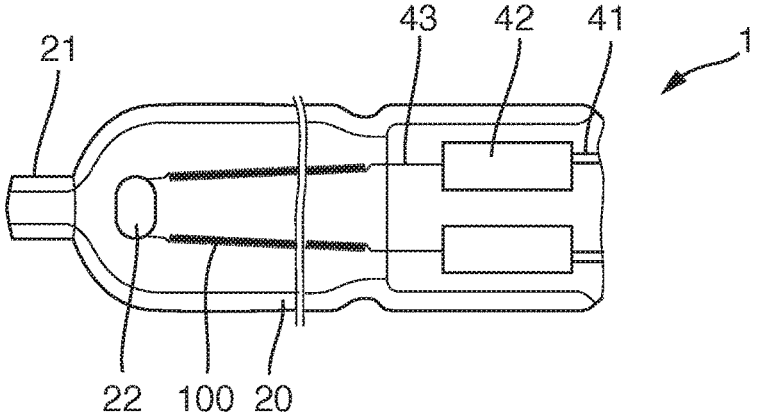

FIGS. 7A and 7B in each case show photographs of a LED light fixture 1, wherein the top side of the LED light fixture 1 is illustrated in each case on the left side and the bottom side with the electrical connectors 43 and the contact pin 41 is shown separately on the right side. FIG. 7A shows the LED light fixture 1 in a side view and FIG. 7B shows the LED light fixture 1 in a plan view.

The LED light fixture 1 contains two dimples 22 in the glass bulb 20. The light modules 20 arranged in the glass bulb 20 are retained and centred by means of the dimples 22. The electrical contacting takes place by means of a connection region 42 (see also FIG. 10).

Figure 7C:
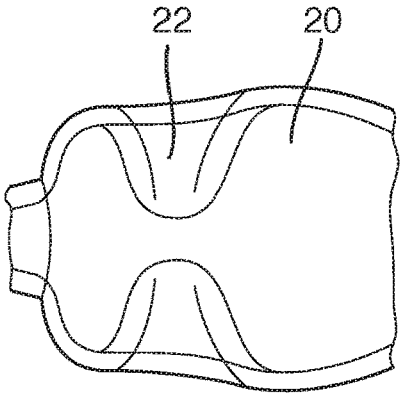
Figure 7D:
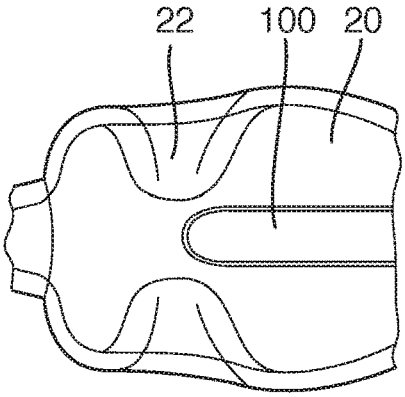

FIGS. 7C and 7D show enlargements of dimples 22 in the glass bulb 20. The dimples 22 are formed as cavities in the glass bulb. Between the dimples 22 a free space is formed into which the circuit board 12 can be clamped.

Figure 7E:
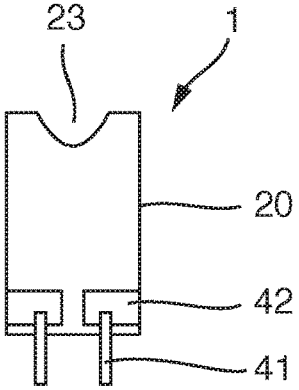

FIG. 7E shows a schematic sketch of a LED light fixture 1. Only the glass bulb 20 as well as the contact pins 41 and the connection region 42 of the LED light fixture 1 are illustrated. The glass bulb 23 has a notch 23 which serves for centring a circuit board 12 in the glass bulb 20. For example, the circuit board 12 can be clamped firmly by means of the notch 23 in the interior space of the glass bulb 20.

Figure 8A:
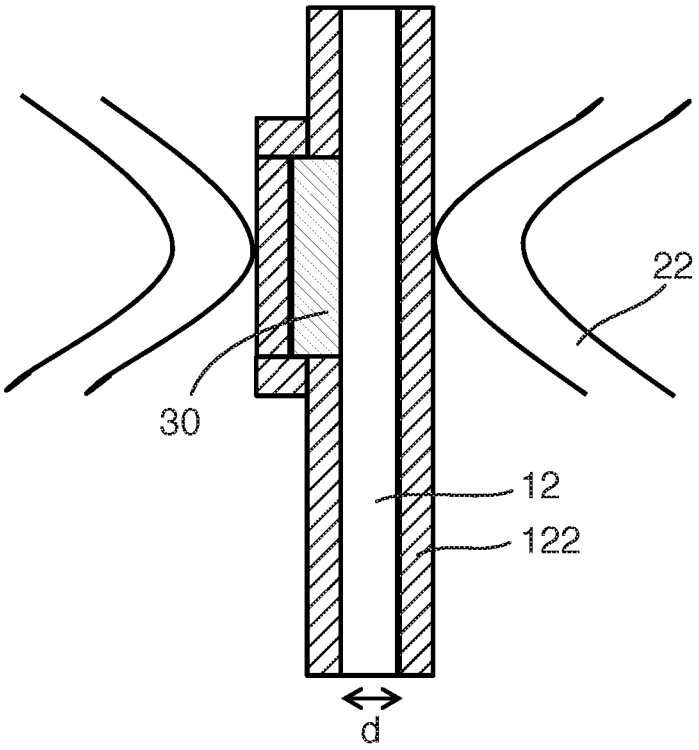
Figure 8B:
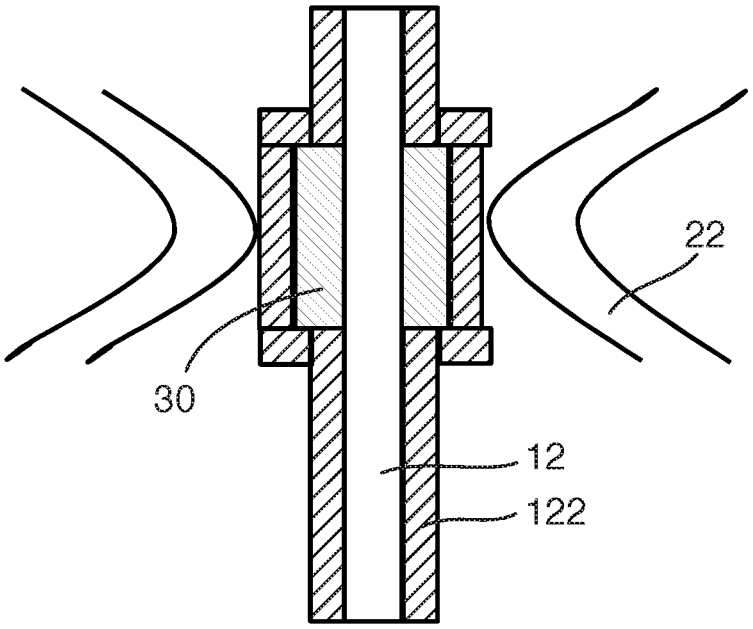

Exemplary embodiments of a LED light fixture 1 described here is explained in greater detail with reference to the schematic sketches of FIGS. 8A and 8B. FIGS. 8A and 8B in each case show enlargements of the region around a dimple 22 in the glass bulb 20 (see also FIGS. 7A to 7D).

Between the dimples 22 shown in FIGS. 8A and 8B there is located in each case an intermediate space in which the circuit board 12 is located. Furthermore, the smoothing capacitor 30 mounted on the circuit board 12 is located between the dimples 22, so that the smoothing capacitor 30 is more or less concealed. In FIG. 8A the smoothing capacitor 30 is only mounted on one side of the circuit board 12, for example the front side, whilst the circuit board 12 of FIG. 8B has a smoothing capacitor 30 on both sides, that is to say on the front side and on the rear side of the circuit board 12.

The circuit board 12 is embedded together with the smoothing capacitor 30 in a mechanically flexible cast body 122. The cast element 122 can be formed from silicone. Furthermore, the cast body 122 can have wavelength-converting particles, so that the view of the smoothing capacitor 30 is additionally concealed.

Deviations of the thickness d of the circuit board 12 and/or the dimensions of the intermediate space between the dimples 22 due to manufacturing tolerances can be compensated for by the cast body 122. Thus the cast body 122 is compressed more or less strongly depending upon the deviation, so that clamping is also facilitated in the event of deviations from an optimal dimension.

Figure 9A:
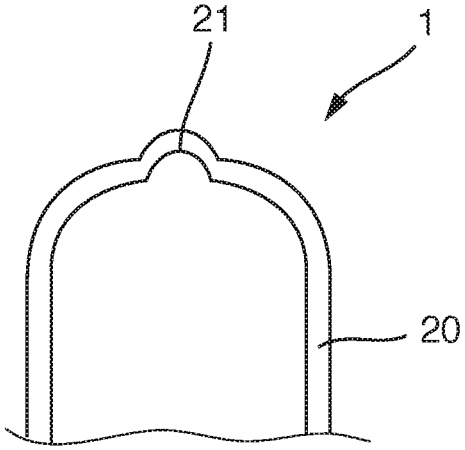

Further exemplary embodiments of a LED light fixture 1 described here is explained in greater detail with reference to the schematic illustrations in FIGS. 9A and 9B. In particular, possible shapes for the glass bulb 20 are shown. In FIG. 9A the glass bulb 20 has the shape of a conventional halogen glass bulb, namely cylindrical with a convexity 21 along an axis of symmetry of the glass bulb 20. A part of the circuit board 12 of the LED light fixture 1 can be arranged in the convexity 21 and in the region of the convexity 21 thermally coupled to the glass bulb 20, so that the heat removal can be improved without having a negative influence on the appearance of the LED light fixture 1.

Figure 9B:
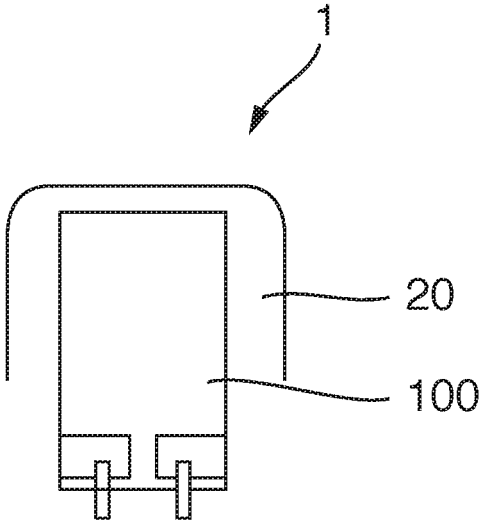

As shown in FIG. 9B, the glass bulb 20 can alternatively have a cuboid configuration and can follow a rectangular shape of the circuit board 12. In general, because the shape of the glass bulb 20 is chosen to be similar to the shape of the circuit board 12 the heat dissipation away from the circuit board 12 can be improved.

Further exemplary embodiments of a LED light fixture 1 described here is explained in greater detail with reference to the schematic illustrations in FIGS. 10A and 10B. In the illustrated exemplary embodiments, the width b of the circuit board 12 corresponds approximately to the greatest internal diameter r of the glass bulb 20. As a result, the circuit board 12 can be retained by the walls of the glass bulb 20. It is possible that the circuit board 12 is embedded in a mechanically flexible cast body 122, so that production tolerances can be compensated for in the width b of the circuit board 12 and/or of the greatest internal diameter r of the glass bulb 20.

Figure 10A:
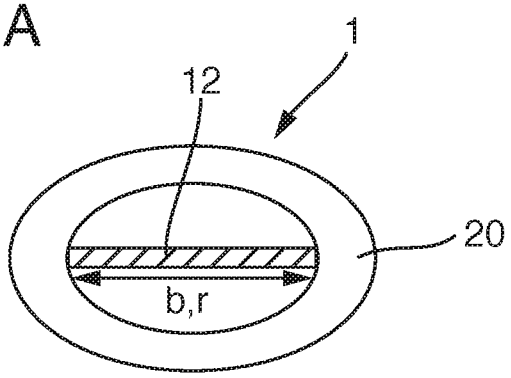
Figure 10B:
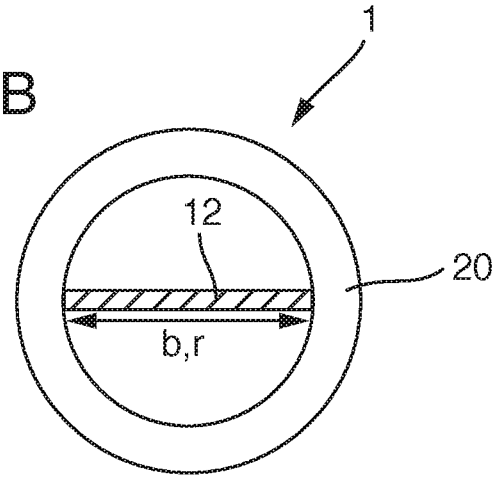

The glass bulb 20 of FIG. 10A has a cylindrical cross-section and the glass bulb 20 of FIG. 10B has a circular cross-section, wherein the cross-section is formed in each case perpendicularly to an axis of symmetry and the glass bulb 20 has a cylindrical shape in each case. For maximisation of the radiating surface, with an elliptical cross-section the width of the circuit board b preferably corresponds to the large half-axis of the ellipse, so that when the circuit board 12 is clamped by means of the walls of the glass bulb 20 the maximum width of the glass bulb 20 can be utilised.

Figure 11A:
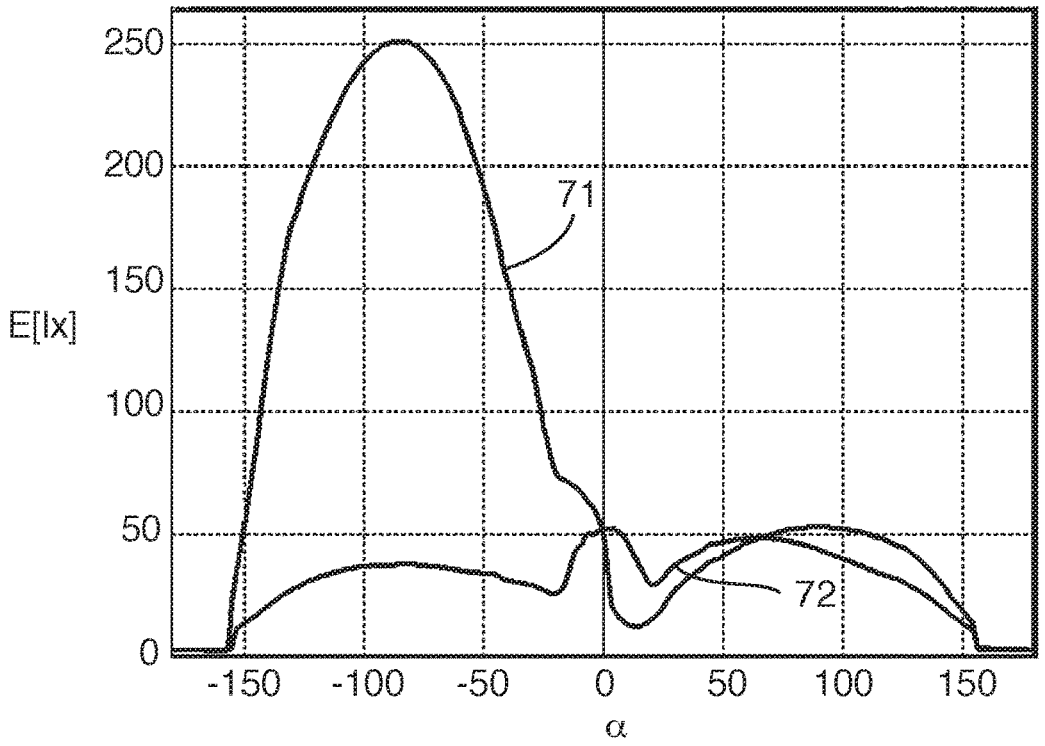
FIGS. 11A, 11B, 12A and 12B show measured illumination intensities and emission characteristics for exemplary embodiments of a LED light fixture described here.

Exemplary embodiments of a LED light fixture 1 described here are explained in greater detail with reference to the measured illumination intensities 71, 72 (in Lux) and emission characteristics 711, 722 (also called: illumination intensity curves) of FIGS. 11A and 11B or 12A and 12C. The measurements have been carried out in each case with a LED light fixture 1 similar to that of FIGS. 1A to 10. FIGS. 11A and 12A show measurements in the case of a LED light fixture 1 with a regular glass bulb 20, whilst the glass bulb 20 of the LED light fixture 1 for the measurements of FIGS. 11B and 12B has been frosted by sand blasting.

Figure 11B:
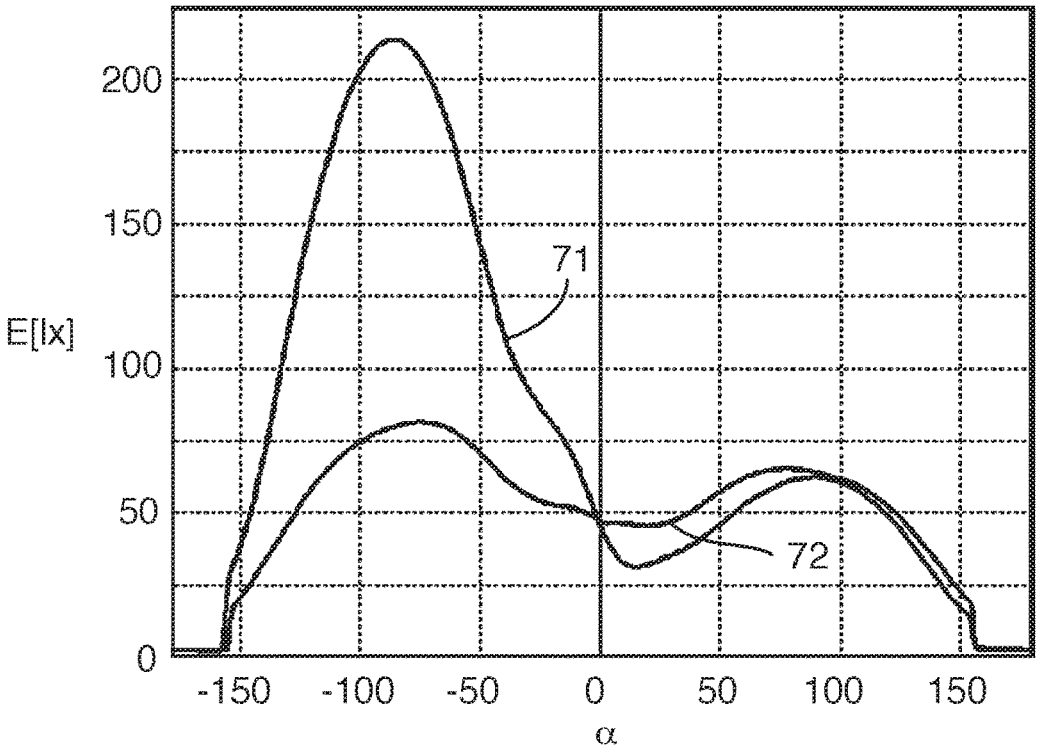
Figure 12A:
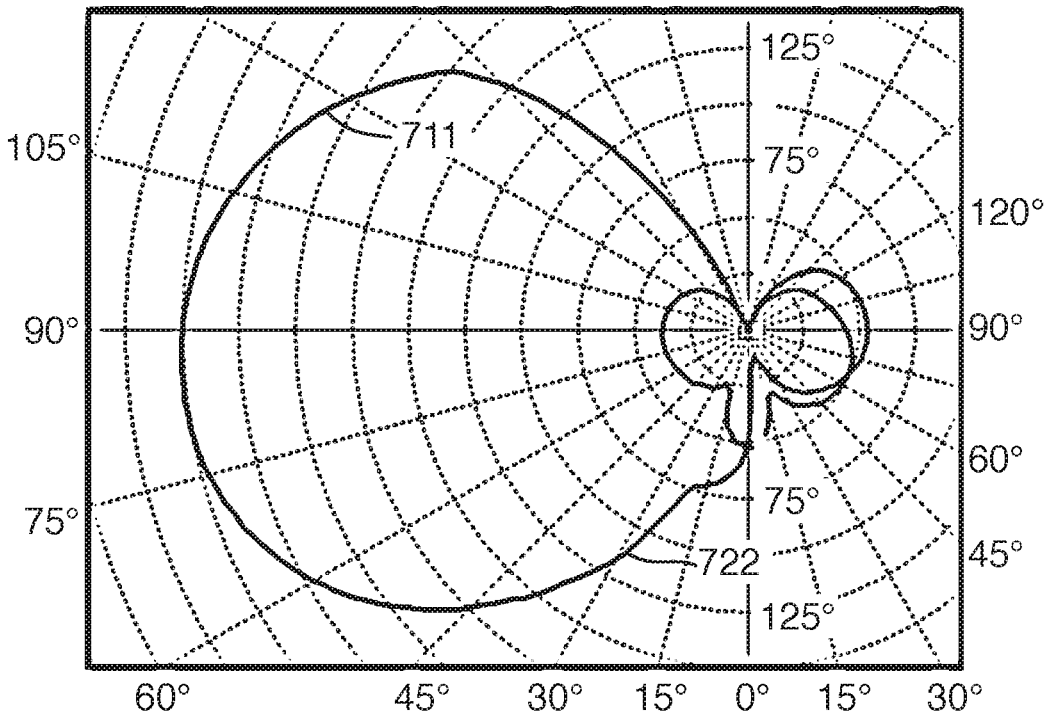
Figure 12B:
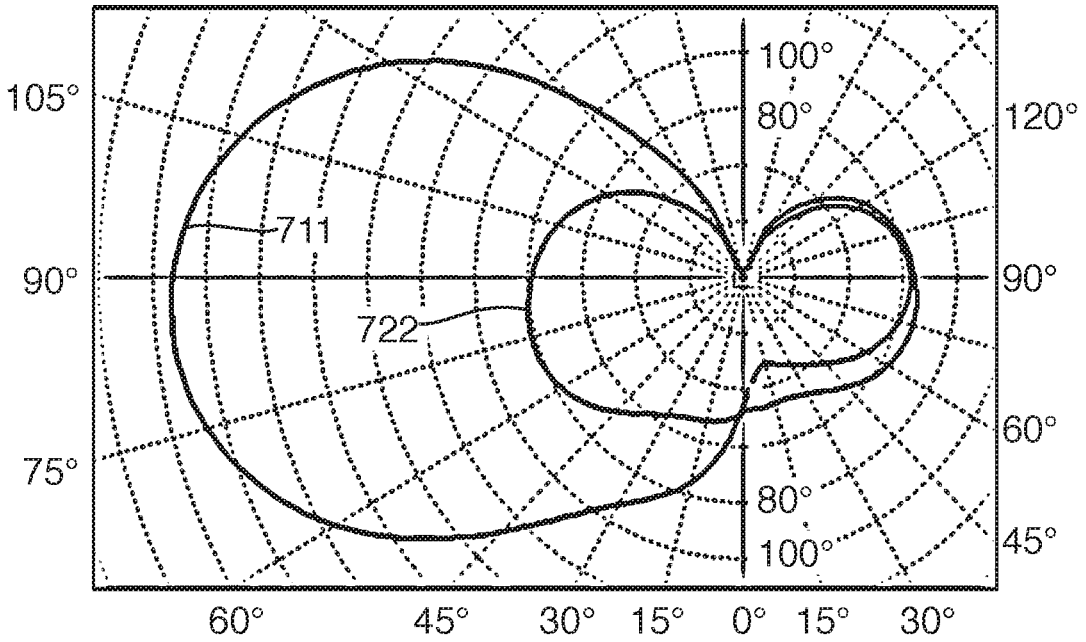

FIGS. 11A and 11B show in each case a first illumination intensity 71, which has been measured in the plane spanned by the lateral directions of the circuit board 12 (that is to say in a plan view of the light emitting diode chip 11), and a second illumination intensity 72, which has been measured in a plane spanned by the vertical direction and the lateral direction of the circuit board 12 extending along the length of the circuit board 12 (that is to say in a side view). The measurement takes place as a function of the respective angle $\alpha$ to the vertical relative to the plane. FIGS. 12A and 12B show a first emission characteristic 711 which has been measured in the measuring plane of the first illumination intensity 71 and a second emission characteristic 722 which has been measured in the measuring plane of the second illumination intensity 72.

Due to the frosting the entire illumination intensity 71, 72 (total of 211 Lumen for FIGS. 11A and 12A and 191 Lumen for FIGS. 11B and 12B, in each case measured at a power von 1.9 Watt). However, the emission characteristic is significantly homogenised and improved. Thus the left-hand maximum of the first illumination intensity 71 in FIG. 11A is approximately 250 Lux and the right-hand maximum of the first illumination intensity 71 is approximately 53 Lux, that is to say only approximately 20% of the value of the left-hand maximum. In FIG. 11A the second illumination intensity 72 is on average significantly less than the first illumination intensity 71 (maximum approximately 51 Lux). In FIG. 11B the left-hand maximum of the first illumination intensity 71 is approximately 215 Lux and the right-hand maximum is approximately 73 Lux, that is to say approximately 30% of the value of the left-hand maximum. The second illumination intensity 72 is significantly increased by comparison with FIG. 11A (maximum approximately 83 Lux).

This homogenisation of the light intensity distribution can also be seen clearly in FIGS. 12A and 12B. In particular in the 0° plane more light is emitted and the Lambertian emission characteristic of the light emitting diode chip 11 is extended. In FIG. 12A it can be seen clearly that the light emitting diode chips 11 are only mounted on the front side of the circuit board 12 (higher radiation in the left-hand region), whilst in FIG. 12B the radiation is less one-sided.

The invention is not limited to these embodiments by the description with reference to the exemplary embodiments. On the contrary, the invention encompasses each new feature as well as any combination of features, in particular including any combination of features in the claims, even if this feature or this combination itself is not explicitly given in the claims or the exemplary embodiments.

LIST OF REFERENCES

1 LED light fixture
11 light emitting diode chip
12 circuit board
122 cast body
100 light module
20 glass bulb
21 convexity
22 dimple
23 notch
30 smoothing capacitor
31 transistor
32 rectifier circuit
321 diode
33 voltage source
41 contact pin
42 connection region
43 electrical connector
431 first connection region
432 second connection region
44 contact point
441 riveting
444 metal clamp
445 opening
446 contact region
447 connection point
23 notch
60 enclosure
61 mounting wires
62 base
71 first illumination intensity
72 second illumination intensity
711 first emission characteristic
722 first emission characteristic
d thickness of the circuit board
r greatest internal diameter of the glass bulb

The invention claimed is:

1. A light emitting diode (LED) light fixture comprising:
a glass bulb;
a light module with at least one light emitting diode chip which is mounted on a circuit board with a chip-on-board assembly; and
a driver of the light module;
wherein the light module and the driver are received in the glass bulb; and
wherein at least one of:
the circuit board is translucent;
the glass bulb has two dimples opposite one another, and wherein the circuit board is clamped between the two dimples; and
the circuit board has a width which corresponds substantially to a greatest internal diameter of the glass bulb.

2. The LED light fixture according to claim 1, wherein at least a part of the driver is mounted on the circuit board with the chip-on-board assembly.

3. A light emitting diode (LED) light fixture comprising:
a glass bulb;
a light module with at least one light emitting diode chip which is mounted on a circuit board with a chip-on-board assembly; and
a driver of the light module;
wherein the light module and the driver are received in the glass bulb;
wherein the driver comprises a smoothing capacitor which is connected to the at least one light emitting diode chip; and
wherein at least one of:
the glass bulb has a dimple which protrudes into an interior space of the glass bulb and is in thermal contact with at least one of the circuit board and the smoothing capacitor;
at least one of the circuit board and the smoothing capacitor are embedded at least partially in a mechanically flexible cast body; and
the smoothing capacitor is parallel-connected to the at least one light emitting diode chip.

4. The LED light fixture according to claim 1, wherein a thickness of the circuit board is at most 400 μm.

5. The LED light fixture according to claim 1, wherein an interior space of the glass bulb is filled with a heat-conducting gas.

6. The LED light fixture according to claim 3, wherein at least one of the circuit board and the smoothing capacitor is thermally coupled to the glass bulb.

7. The LED light fixture according to claim 1, wherein the glass bulb has a notch which protrudes into an interior space of the glass bulb, extends along an axis of symmetry of the glass bulb, and is configured for centering of the light module inside the glass bulb.

8. The LED light fixture according to claim 3, wherein the glass bulb has a convexity with respect to an interior space of the glass bulb, and wherein the circuit board and the smoothing capacitor are received at least partially in the convexity.

9. The LED light fixture according to claim 1, wherein the glass bulb is at least one of: formed with frosted glass; and is matte.

10. An LED lamp comprising:

an enclosure; and the LED light fixture according to claim 1 arranged inside the enclosure.

11. A light emitting diode (LED) light fixture comprising:

a bulb;

a light module with at least one light emitting diode chip which is mounted on a circuit board with a chip-on-board assembly; and a driver of the light module;

wherein the bulb has a notch which protrudes into an interior space of the bulb, extends along an axis of symmetry of the bulb, and is configured for centering of the light module inside the bulb; and wherein the light module and the driver are received in the bulb.

12. A light emitting diode (LED) light fixture comprising:

a bulb;

a light module with at least one light emitting diode chip which is mounted on a circuit board with a chip-on-board assembly;

a driver of the light module; and a smoothing capacitor connected to the at least one light emitting diode chip;

wherein the bulb has a convexity with respect to an interior space of the bulb, and wherein the circuit board and the smoothing capacitor are received at least partially in the convexity; and wherein the light module and the driver are received in the bulb.

13. An LED lamp comprising:

an enclosure; and the LED light fixture according to claim 3 arranged inside the enclosure.

14. An LED lamp comprising:

an enclosure; and the LED light fixture according to claim 11 arranged inside the enclosure.

15. An LED lamp comprising:

an enclosure; and the LED light fixture according to claim 12 arranged inside the enclosure.

* * * * *